United States Patent [19]

Budzich

[11] 4,325,408

[45] Apr. 20, 1982

[54] EXHAUST PRESSURIZATION OF LOAD RESPONSIVE SYSTEM

[76] Inventor: Tadeusz Budzich, 80 Murwood Dr., Moreland Hills, Ohio 44022

[21] Appl. No.: 228,683

[22] Filed: Jan. 26, 1981

Related U.S. Application Data

[63] Continuation-in-part of Ser. No. 49,660, Jun. 18, 1979, Pat. No. 4,249,570.

[51] Int. Cl.[3] ..... F15B 13/08

[52] U.S. Cl. ..... 137/596.2; 60/427; 91/436; 91/446; 91/451; 137/596.13

[58] Field of Search ..... 60/427; 91/436, 446, 91/451; 137/596.13, 596.2

[56] References Cited

U.S. PATENT DOCUMENTS

| | | | |
|---|---|---|---|
| 4,082,111 | 4/1978 | Budzich | 91/436 X |
| 4,089,167 | 5/1978 | Budzich | 137/596.13 X |
| 4,099,379 | 7/1978 | Budzich | 91/436 X |
| 4,107,923 | 8/1978 | Budzich | 137/596.13 X |
| 4,122,677 | 10/1978 | Budzich | 60/427 |
| 4,174,613 | 11/1979 | Budzich | 91/436 X |

*Primary Examiner*—Gerald A. Michalsky

[57] ABSTRACT

In a load responsive fluid power and control system employing plurality of control valves with positive and negative load compensation, a pressurized exhaust system supplied with make-up fluid from pump discharge circuit by a pressure reducing valve and deactivating valve of the pressure reducing valve operable when the pessurized exhaust system is completely unloaded during control of positive load.

8 Claims, 2 Drawing Figures

EXHAUST PRESSURIZATION OF LOAD RESPONSIVE SYSTEM

This application is a continuation-in-part of application Ser. No. 049,660, filed June 18, 1979, for "Exhaust Pressurization Of Load Responsive System," now U.S. Pat. No. 4,249,570.

BACKGROUND OF THE INVENTION

This invention generally relates to a fluid power and control system, in which the pressurized exhaust flow of the system motors supplement their inlet flow requirements during control of negative loads.

In still more particular aspects this invention relates to pressurized exhaust system of a plurality of fluid motors, controlled by load responsive valves, the exhaust system being pressurized by fluid flow from the pump discharge passed through a pressure reducing valve during control of negative loads.

In still more particular aspects this invention relates to a load responsive fluid power and control system, in which the exhaust flow of system motors is supplemented by flow from the pump discharge through a pressure reducing valve, this pressure reducing valve being made ineffective and the exhaust system depressurized during control of positive load.

Pressurization of the exhaust flow from system motors and supplementing the exhaust flow from pump discharge is very desirable, since it provides inlet flow requirement of the motors subjected to negative loads. It suffers however, from one basic disadvantage and that is that all of the pump discharge flow is bypassed to the exhaust system, by the pressure reducing valve, during control of positive load, when system exhaust is depressurized.

SUMMARY OF THE INVENTION

It is therefore a principal object of this invention to reduce the total pump output by blocking off its flow during control of negative loads, reduce exhaust fluid flow fluctuations and use the system exhaust flow to supply the inlet flow requirement of the motors subjected to negative load.

It is a further object of this invention to supplement the exhaust flow from the system motors from the pump discharge through a pressure reducing valve, during control of negative loads.

It is a further object of this invention to deactivate the pressure reducing valve and unload the exhaust system pressure during control of positive load.

Briefly the foregoing and other objects of this invention are accomplished by pressurizing the exhaust circuit of the load responsive system valves, during control of negative loads, from the pump discharge circuit by a throttling process, with the use of a pressure reducing valve. While controlling positive loads the pressure reducing valve is automatically deactivated and the total exhaust system depressurized.

Additional objects of this invention will become apparent when referring to the preferred embodiment of the invention as shown in the accompanying drawings and described in the following detailed description.

DESCRIPTION OF THE PREFERRED EMBODIMENT

Figure 1:
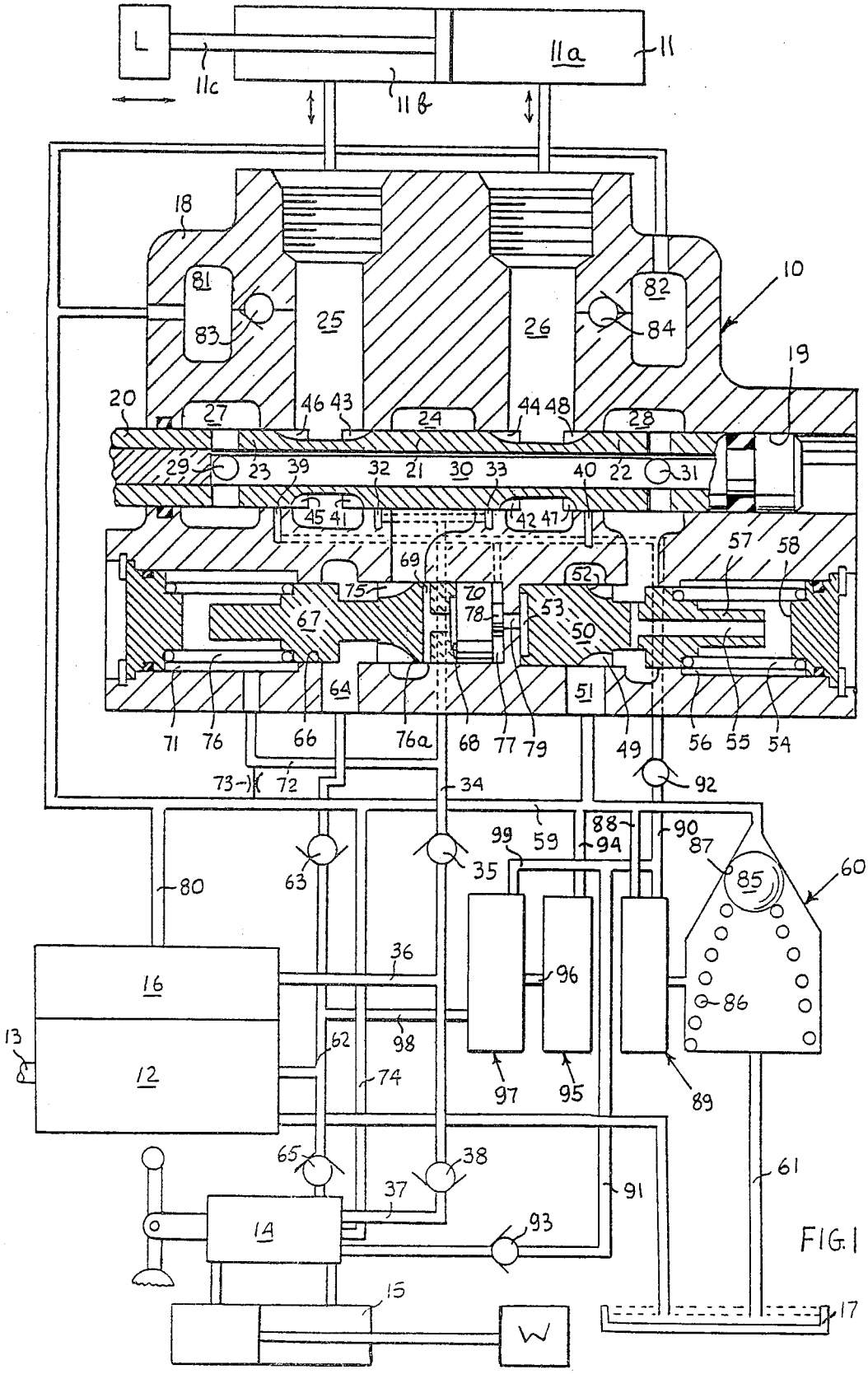
FIG. 1 is a sectional view of an embodiment of a flow control valve having positive and negative load compensation with the pressure reducing valve, pressure reducing deactivating valve, exhaust system unloading valve, lines, system flow control, system pump, second load responsive valve and exhaust relief valve shown diagrammatically.

Referring now to FIG. 1, an embodiment of a flow control valve, generally designated as 10, is shown interposed between diagrammatically shown fluid motor having chambers 11*a* and 11*b* and piston rod 11*c*, connected to a load L and a pump 12 of a fixed displacement or variable displacement type driven through a shaft 13 by a prime mover not shown.

Similarly, a flow control valve 14, identical to flow control valve 10, is interposed between a diagrammatically shown fluid motor 15 driving a load W and the pump 12. Fluid flow from the pump 12 to flow control valves 10 and 14 is regulated by a pump flow control 16. If pump 12 is of a fixed displacement type, pump flow control 16 is a differential pressure relief valve, which, in a well known manner, by bypassing fluid from the pump 12 into the exhaust circuit, maintains discharge pressure of pump 12 at a level, higher by a constant pressure differential, than load pressure developed in fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21, 22, 23 which in neutral position of the valve spool 20, as shown in the drawing, isolate a fluid supply chamber 24, load chambers 25 and 26 and outlet chambers 27 and 28. The outlet chamber 27 is connected through ports 29, central passage 30 in valve spool 20 and ports 31 to the outlet chamber 28.

Positive load sensing ports 32 and 33, located between load chambers 25 and 26 and the supply chamber 24 and blocked in neutral position of valve spool 20 by land 21, are connected through signal passage 34, a check valve 35 and signal line 36 to pump flow control 16. In a similar manner positive load sensing ports of flow control valve 14 are connected through line 37, a check valve 38 and signal line 36 to the pump flow control 16. Negative load sensing port 39 is located between load chamber 25 and outlet chamber 27. Similarly, negative load sensing port 40 is located between load chamber 26 and outlet chamber 28.

The land 21 of the valve spool 20 is equipped with signal slots 41 and 42, located in plane of positive load sensing ports 32 and 33 and metering slots 43 and 44, which, in a well known manner, can be circumferentially spaced in respect to each other and in respect to the signal slots 41 and 42. The land 23 is equipped with signal slot 45, located in plane of negative load sensing port 39 and circumferentially spaced metering slot 46. The land 22 is equipped with signal slot 47, located in plane of negative load sensing port 40 and circumferentially spaced metering slot 48. Signal slots 41, 42, 45 and 47, in a well known manner, can be substituted by end surfaces of lands 21, 22 and 23. A suitable device is provided to prevent relative rotation of the spool 20 in respect to bore 19.

The outlet chamber 28 is connected through slots 49, of a negative load control spool 50, to an exhaust chamber 51. The negative load control spool 50 having slots 49, provided with throttling edges 52, projects into control space 53 and is biased towards position, as shown, by spring 54. The negative load control spool 50 is provided with passage 55 connecting the outlet chamber 28 with space 56 and is equipped with stop 57, limiting its displacement against surface 58. The exhaust chamber 51 in turn is connected to exhaust line 59. An exhaust relief valve, generally designated at 60, communicates exhaust line 59 through line 61 to the reservoir 17.

The pump 12 through its discharge line 62 and load check 63, is connected to a fluid inlet chamber 64. Similarly, discharge line 62 is connected through load check valve 63 with the inlet chamber of the fluid control valve 14. The control bore 66 connects the fluid inlet chamber 64 with the fluid supply chamber 24. The control spool 67, axially slidable in control bore 66, projects on one end into space 68, connected to the fluid supply chamber 24 by passage 69 and abuts against a free floating piston 70. The control spool 67 on the other end projects into control space 71, which is connected by passage 72 with positive load sensing ports 32 and 33 and through leakage orifice 73 to exhaust line 59 and to upstream of exhaust relief valve 60. Similarly, control space and leakage orifice of the control valve 14 is connected by line 74 to upstream pressure of exhaust relief valve 60. The control spool 67 is provided with slots 75 terminating in throttling edges 76*a*, positioned between the inlet chamber 64 and the supply chamber 24. The control spool 67 is biased by a control spring 76 towards position, in which slots 75 connect the fluid supply chamber 24 with the fluid inlet chamber 64.

The free floating piston 70 on one end is subjected to pressure in space 68, which is connected to the fluid supply chamber 24 and on the other end is subjected to pressure in control space 77, which is connected to negative load pressure sensing ports 39 and 40. Projection 78 of the free floating piston 70, in the position as shown, effectively seals port 79 and control space 53 from control space 77.

The exhaust relief valve, generally designated as 60, is interposed between combined exhaust circuits of flow control valves 10 and 14, including bypass circuit of pump 12 and reservoir 17. The pressurized exhaust circuit of flow control valve 10 includes exhaust line 59 conneced to bypass line 80 and connected to chambers 81 and 82, which are operationally connected for one way fluid flow by check valves 83 and 84 with load chambers 25 and 26. The exhaust relief valve 60 is provided with a throttling member 85, biased by a spring 86 towards engagement with seat 87.

The combined exhaust circuits of flow control valves 10 and 14 are connected by line 88 to an exhaust unloading valve, generally designated as 89. The exhaust unloading valve 89 is also connected through lines 90 and 91 and check valves 92 and 93 with the negative load sensing ports 39 and 40, of the flow control valves 10 and 14. The total exhaust circuits of flow control valves 10 and 14 are also connected through exhaust line 59 and line 94 to a pressure reducing valve, generally designated and 95, line 96 and a cut-off valve, generally designated as 97 and line 98 to discharge line 62. The cut-off valve 97 is also connected through line 99 to the negative load sensing ports 39 and 40 of flow control valves 10 and 14.

Figure 2:
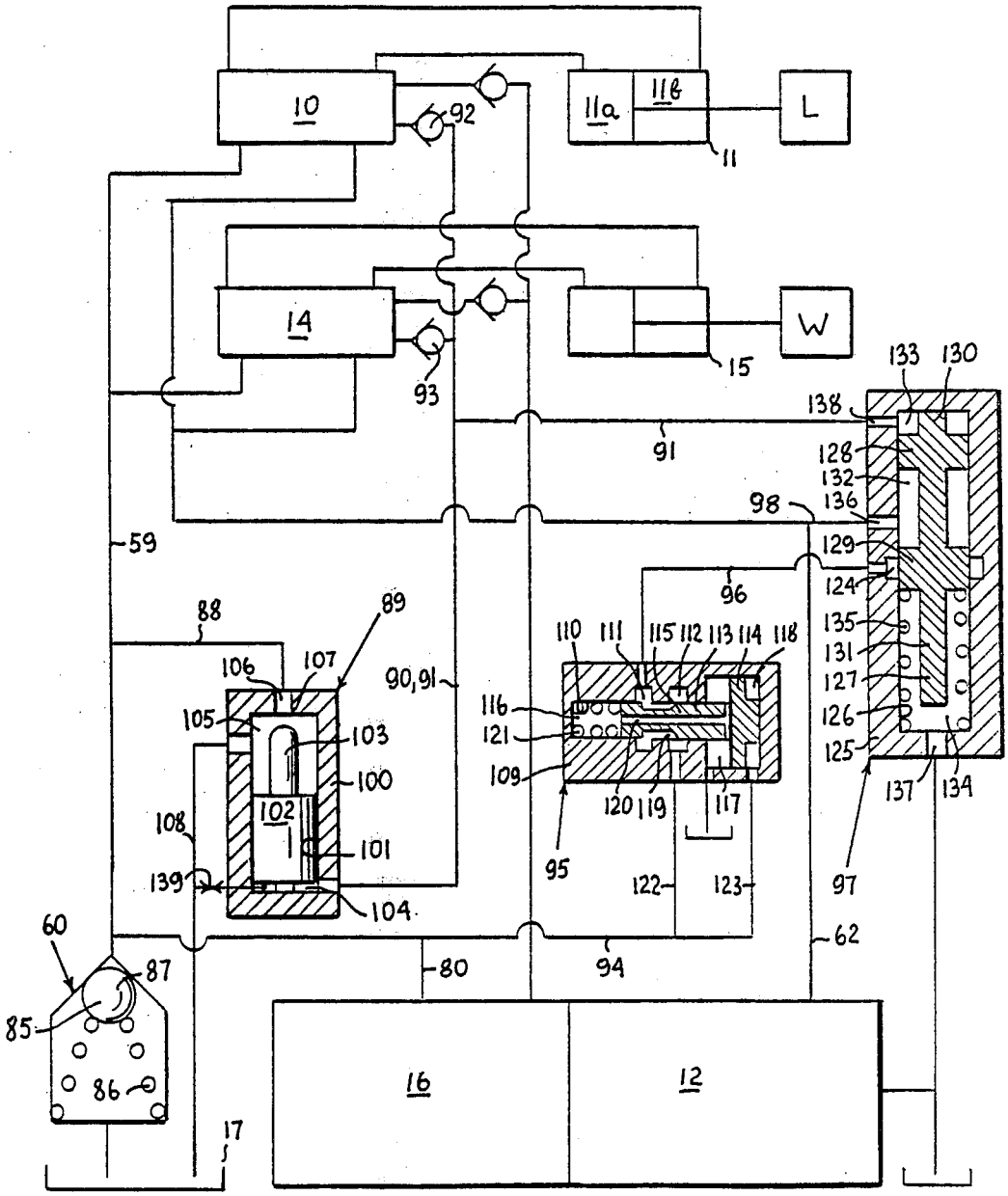
FIG. 2 is a schematic representation of the elements of FIG. 1 with the pressure reducing valve, pressure reducing deactivating valve and exhaust system unloading valve shown in section.

Referring now to FIG. 2 the total fluid power and control system of FIG. 1 is shown schematically with the control elements of the pressurized exhaust circuit namely the exhaust unloading valve, generally designated as 89, the pressure reducing valve, generally designated as 95 and the cut-off valve, generally designated as 97 shown in section, the same components of FIGS. 1 and 2 being designated by the same numerals. The exhaust unloading valve 89, interposed between pressurized exhaust circuits of flow control valves 10 and 14 and the system reservoir, has a housing 100 provided with a bore 101, slidably guiding, in sealing engagement, a cut-off spool 102, provided with cut-off extension 103. The space defined by bore 101 is divided by the cut-off spool 102 into a control chamber 104 and an unloading chamber 105. The unloading chamber 105 communicates through line 88, port 106 and a seat 107 with the pressurized exhaust system, while also communicating through line 108 with the system reservoir 17. The control chamber 104 is connected with lines 90, 91 and check valves 92 and 93 to the negative load sensing ports, of flow control valves 10 and 14.

The pressure reducing valve, generally designated as 95, comprises a housing 109 provided with bore 110 having annular spaces 111 and 112 and guiding a control piston 113, provided with a head section 114 and a stem section 115, which define chambers 116, 117 and 118. The stem section 115 is provided with throttling slots 119 and passage 120, connecting chambers 116 and 117 and is biased towards position, as shown in FIG. 2, by a spring 121. Annular space 112 and chamber 116 are connected by lines 122 and 123 with line 94 leading to the pressurized exhaust system. Annular space 111 is connected by line 96 with annular space 124 of the cut-off valve, generally designated as 97. The cut-off valve 97 comprises a housing 125, provided with bore 126, slidably guiding in sealing engagement cut-off spool 127, provided with lands 128 and 129 and stops 130 and 131. Lands 128 and 129 define annular space 132 and chambers 133 and 134. The cut-off spool 127 is biased, towards position as shown in FIG. 2, in which the land 129 isolates annular space 124, by a spring 135. Annular space 132 is connected through port 136 with line 98, connected to discharge line 62. The chamber 134 communicates through port 137 with the system reservoir. The chamber 133 communicates by port 138 with line 91, connected to the negative load sensing system of the flow control valves 10 and 14.

Referring now to the drawings and specifically to FIG. 1, with the pump 12 of a fixed displacement type started up, the pump flow control 16 will bypass all of the pump flow through line 80 to exhaust line 59. From exhaust line 59 all of the bypass flow will be passed through line 88 and the exhaust unloading valve 89 to the system reservoir 17, in a manner as will be described in detail when referring to FIG. 2. Any displacement of the valve spool 20 from neutral position will connect one of the load sensing ports 32 or 33 with load chambers 25 or 26, while also connecting one of the negative load sensing ports 39 or 40 with the load chambers 25 and 26. If the controlled load is positive the negative load pressure will be zero and no negative load pressure signal will be transmitted through the check valves 92 and 93 to line 90, leading to the exhaust unloading valve 89, the bypassing action of the exhaust unloading valve 89 not being affected. Therefore with the valve spool 20 in neutral position, or with the valve spool 20 controlling a positive load, all of the exhaust flow, from the fluid motors 11 or 15, will be transferred to the reservoir 17 at atmospheric pressure, completely bypassing the exhaust relief valve 60, providing the system with a minimum throttling loss. However, during control of negative load the negative load pressure signal will be transmitted through the logic system of check valves 92 and 93 to the exhaust unloading valve 89, closing the bypass passage to the reservoir 17, in a manner as will be described when referring to FIG. 2, forcing all of the exhaust flow from fluid motors 11 and 14 and bypass flow from fixed displacement pump 12 to pass through the exhaust relief valve 60, thus automatically pressurizing the exhaust system. Assume that negative load L is controlled by the flow control valve 10, with the chamber 11*b* being subjected to negative load pressure. The exhaust flow from the chamber 11*b* is smaller, by the displacement of the piston rod 11*c*, than the inlet flow requirement of the fluid motor 11 into chamber 11*a*. During control of negative load the free floating piston 70, subjected to negative load pressure, will move the control spool 67 all the way to the left, cutting off communication between the inlet chamber 64 and the fluid supply chamber 24. Therefore all of the inlet flow requirement into chamber 11*a* must be supplied at exhaust pressure level, as dictated by the setting of the exhaust relief valve 60 from the pressurized exhaust system, connected to chamber 82 through the check valve 84, the flow passing through the exhaust relief valve 60 being reduced, by the flow displacement of the piston rod 11*c*, all of the fluid from the chamber 11*b* being transferred into the chamber 11*a*, this flow being supplemented by the bypass flow from the fixed displacement pump 12. The pressure setting of the exhaust relief valve 60 is so selected that during control of negative loads all of the fluid flow within the exhaust circuit can provide the inlet flow requirement of the fluid motor at positive pressure levels, no cavitation taking place.

With pump 12 of a variable displacement type no bypass flow is supplied to the exhaust circuit from the system pump. If the load controlled by flow control valve 10 is positive, a zero negative load pressure signal is transmitted to the exhaust unloading valve 89, which, in a manner as previously described, will bypass all of the exhaust flow from the fluid motors 11 and 15 to the system reservoir at atmospheric pressure, completely bypassing the exhaust pressure relief valve 60. During control of negative load, in a manner as previously described, all the exhaust flow from the fluid motors 11 and 15 must either pass through the exhaust relief valve 60, at its pressure setting, or be used in providing the inlet flow requirement of the fluid motors, which, in a manner as previously described, are cut off by control spool 67 from pump discharge. Assume that fluid motor 11 controls a negative load, the chamber 11*a* being subjected to negative load pressure. Since, in a manner as previously described the outlet flow from the chamber 11*a* is greater than inlet flow to the chamber 11*b*, by the displacement of the piston rod 11*c*, all of the inlet flow requirements into the chamber 11*b* can be provided through check valve 83 from the outlet flow from the chamber 11*a*, only the flow, equivalent to the displacement of the piston rod 11*c*, passing through the exhaust relief valve 60. If the direction of the negative load is reversed and the chamber 11*b* is subjected to negative load pressure, the displacement from the chamber 11*b* is smaller, by the displacement of piston rod 11*c*, than the inlet flow requirement of the chamber 11*a*. Under those conditions, with the exhaust unloading valve 89 closed, the throttling member 85 will seat and the pressure in the exhaust circuit would drop below the atmospheric level. This is prevented by the pressure reducing valve 96, working in cooperation with the cut-off valve 97, which, an a manner as will be described when referring to FIG. 2, will bypass enough flow from the discharge circuit of the pump 12, to pressurize the exhaust circuit at a level, lower than the setting of the exhaust relief valve 60.

Referring now to FIG. 2, the fluid power and control system is shown either with the flow control valves 10 and 14 in their neutral position, or controlling the positive load. Since no negative load pressure is transmitted to the control chamber 104, of the exhaust unloading valve 89, the cut-off spool 102, with its cut-off extension 103, will move away from seat 107, effectively cross-connecting, through line 88 and unloading chamber 105, the exhaust circuit with the system reservoir, completely bypassing the exhaust relief valve 60. Also due to the absence of the negative load pressure signal the chamber 133, of the cut-off valve 97, is subjected to atmospheric pressure and the cut-off spool 127, biased by spring 135, assumes the position as shown in FIG. 2, isolating annular space 124 from annular space 132, which is subjected to the pump discharge pressure. Therefore, in the position of the cut-off spool 127, as shown in FIG. 2, the pressure reducing valve 95 is isolated from the source of high pressure oil and becomes completely inactive. If the cut-off valve 97 would be excluded from the circuit of FIG. 2 and the pressure reducing valve 95 permanently connected to the discharge line 62, with the exhaust circuit maintained at atmospheric pressure by the exhaust unloading valve 89, the pressure reducing valve 95, trying to maintain the exhaust system pressurized, would divert the entire discharge flow of the variable displacement pump 12 into the exhaust circuit, making operation of the positive load impossible. During control of negative load the negative load pressure will automatically close the flow through the exhaust unloading valve 89 and will also move the cut-off valve spool 127, of the cut-off valve 97 downward, connecting the discharge line 62, through annular spaces 132 and 124 and line 96, with the pressure reducing valve 95. Note that the control chamber 104, connected to the negative load sensing ports of flow control valves 10 and 14 is also connected by leakage orifice 139 to the reservoir 17. The preload of the spring 110, of the pressure reducing valve 95, is so selected that the exhaust pressure, equivalent to the setting of the exhaust relief valve 60, acting on the cross-sectional area of the head section 114 will move the control piston 113 from right to left, with throttling slots 119 being completely cut off. If the fluid motor 11 of FIG. 1 contains negative load pressure in chamber 11*a*, the flow from the chamber 11*a* is larger than the flow into the chamber 11*b*, the exhaust relief valve 60 remains open, bypassing the exhaust flow and the pressure reducing valve 95, connected by cut-off valve 97 to the discharge of the variable pump 12, remains in a closed position, effectively isolating the pump discharge circuit from the exhaust circuit. Under those conditions full transfer of the fluid from the chamber 11*a* to chamber 11*b* takes place through the check valve 83 of FIG. 1, with the exhaust circuit remaining pressurized at the setting of the exhaust relief valve 60, the exhaust relief valve 60 bypassing exhaust flow, equal to the volume displaced by the piston rod 11*c*. With fluid motor 11 subjected to negative load pressure in the chamber 11*b*, the outlet flow of the fluid motor 11 will be smaller than its inlet flow requirement into the chamber 11*a*, the exhaust pressure relief valve 60 will close and the pressure in the exhaust circuit will drop to a level, at which the preload in the spring 110, of the pressure reducing valve 95, will overcome the hydraulic force, developed on the head section 114, with the control piston 113 moving from left to right into a modulating position, throttling with throttling slots 119 enough pressure fluid from the pump discharge circuit, to maintain the exhaust circuit at this reduced pressure level. The amount of fluid throttled from the discharge circuit into the exhaust circuit will be equal exactly to the volume of fluid, equal to the displacement of the piston rod 11*c*. Therefore, with the exhaust relief valve 60 closed, the pressure reducing valve 95 will automatically divert enough of the fluid from the pump discharge circuit to maintain the exhaust circuit at a lower pressure level, which is still high enough to prevent cavitation at the fluid motor inlet, during control of negative load. With the controlled load becoming positive and the negative load becoming zero the cut-off valve 97 will isolate the pressure reducing valve 95 from the pump discharge circuit, making it completely ineffective, while automatically the exhaust pressure of the exhaust circuit is lowered, by the exhaust unloading valve 89, to atmospheric level. Under those conditions the circuit of FIG. 2 can control positive loads with maximum efficiency and minimum throttling loss. In the absence of the cut-off valve 97 the operation of the positive load would be impossible, since the pressure reducing valve 95, through the exhaust unloading valve 89 would bypass the entire output flow of the pump 12 into the exhaust circuit, making the control system of FIG. 2 inoperative. By use of the cut-off valve 97 the control circuit of FIG. 2 unloads the exhaust system to atmospheric level, during control of positive loads, maintains the exhaust system pressurized, at the setting of the exhaust pressure relief valve 60, when the negative load is being controlled from the chamber 11*a* and with the exhaust relief valve 60 closed, during operation of negative load, when controlling the negative load from the chamber 11*b*, maintains the exhaust system at a lower pressure level, equivalent to the setting of the pressure reducing valve 95, with some of the fluid from the discharge circuit being bypassed into the exhaust circuit, to permit the fluid transfer into the chamber 11*a* through the check valve 84 without cavitation, see FIG. 1.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A fluid power and control system supplied with pressure fluid by a pump and connected to an exhaust manifold communicable with a reservoir, said fluid power and control system comprising a control valve assembly connected to said pump and said exhaust manifold, said valve assembly having first and second load chambers, positive load pressure sensing means, negative load pressure sensing means, isolating means responsive to pressure in said negative load pressure sensing means and operable to selectively disconnect said control valve assembly from said pump, and fluid replenishing means operable to interconnect for one way fluid flow said load chambers and said exhaust manifold, exhaust manifold pressurizing means, exhaust pressure relief valve means operably connected to said exhaust manifold, pressure reducing valve means interconnecting said pump and said exhaust manifold and deactivating means of said pressure reducing valve means.

2. A fluid power and control system as set forth in claim 1 wherein said control valve assembly has direction control valve means for selectively interconnecting said load chambers with said pump and said exhaust manifold.

3. A fluid power and control system as set forth in claim 1 wherein said exhaust manifold pressurizing means has means responsive to pressure in said negative load pressure sensing means.

4. A fluid power and control system as set forth in claim 1 wherein said deactivating means of said pressure reducing valve means has means responsive to pressure in said negative load pressure sensing means.

5. A fluid power and control system as set forth in claim 1 wherein said exhaust pressure relief valve means has means limiting the pressure in said exhaust manifold at a certain preselected first level and said pressure reducing valve means has means responsive to exhaust manifold pressure at a certain preselected second level, said second preselected level being lower than said first preselected level.

6. A fluid power and control system as set forth in claim 1 wherein said exhaust manifold pressurizing means has means for selectively interconnecting said exhaust manifold to said reservoir.

7. A fluid power and control system as set forth in claim 1 wherein said pressure reducing valve means has means responsive to pressure in said exhaust manifold.

8. A fluid power and control system as set forth in claim 1 wherein said deactivating means of said pressure reducing valve means has disconnecting means operable to disconnect said pump from said pressure reducing valve means when pressure in said negative load pressure sensing means drops below a certain predetermined level.

* * * * *